US006290080B1

(12) United States Patent
Grosse

(10) Patent No.: US 6,290,080 B1
(45) Date of Patent: Sep. 18, 2001

(54) NURSING BOTTLE

(76) Inventor: Vincent Depaul Grosse, 11620 N. 32nd Dr., Phoenix, AZ (US) 85029

( * ) Notice: Subject to any disclaimer, the term of this patent is extended or adjusted under 35 U.S.C. 154(b) by 0 days.

(21) Appl. No.: 09/494,642

(22) Filed: Jan. 31, 2000

(51) Int. Cl.[7] ..... A61J 11/00; A61J 11/02
(52) U.S. Cl. ..... 215/11.1; 215/11.5
(58) Field of Search ..... 215/11.1, 11.5, 215/11.6

(56) References Cited

U.S. PATENT DOCUMENTS 2,809,760 * 10/1957 Clark ..... 215/11.6
2,982,432 * 5/1961 Mehl ..... 215/11.1
3,061,129 * 10/1962 Fitzgerald ..... 215/11.6
3,394,018 * 7/1968 Velonis et al. ..... 215/11.1 X
3,405,829 * 10/1968 Siravo ..... 215/11.1 X
3,512,301 * 5/1970 Kramer ..... 215/11.6 X
4,050,600 * 9/1977 Jennings ..... 215/11.1
4,053,648 * 10/1977 Schmid et al. ..... 215/11.1 X
4,865,207 9/1989 Joyner et al. .
4,930,645 * 6/1990 Warehime ..... 215/11.1
5,509,549 * 4/1996 Marandola ..... 215/11.1 X

* cited by examiner

*Primary Examiner*—Sue A. Weaver
(74) *Attorney, Agent, or Firm*—Snell & Wilmer L.L.P.

(57) ABSTRACT

An improved nursing bottle, having: a semi-permeable washer assembly to create an open system and reduce infant gas consumption; a hemispherical closed end to improve manual cleanability; and fine motor dexterity rings to improve the fine motor skills of an infant and to make the bottle easier to grip.

37 Claims, 2 Drawing Sheets

NURSING BOTTLE

FIELD OF THE INVENTION

This invention relates generally to nursing bottles and, more specifically, to an improved nursing bottle having the characteristics of reduced gas build-up, easier cleanability, improved gripability, and increased fine motor skills development.

BACKGROUND OF THE INVENTION

Nursing bottles are, of course, commonly utilized in the feeding of infants. There are several problems with existing nursing bottles, however. These include bloating and excess gas consumption during feeding, causing the infant to experience discomfort. In addition, current bottles may be difficult to clean manually. Finally, prior art nursing bottles may not be contributing sufficiently to the development of fine motor skills of the infant's hands and fingers.

Thus, with respect to excessive gas consumption, typical nursing bottles provide only one aperture for both liquid to be delivered to an infant as well as for air to enter a bottle. Under this arrangement, known in the art as a closed system, when an infant begins suctioning liquid out of a nipple, negative pressure begins to build inside the bottle. Eventually, when this negative pressure inside the bottle equals the positive pressure outside the bottle, the infant can no longer receive liquid out of the bottle. The infant is then forced to cease suctioning, and take a breath. When this happens, the negative pressure within the bottle draws air into the bottle through the aperture in the nipple. This air then mixes with the liquid inside the bottle, forming air bubbles within the liquid. When the infant resumes nursing, the air bubbles are consumed, often causing the infant gas and discomfort.

Many existing nursing bottles are also difficult to clean by hand due to a flat closed end design. This design makes it difficult to efficiently fit a cleaning instrument, such as a brush, into all portions of a closed end of the bottle.

Many nursing bottles provide a gripping aid that only develops an infant's gross motor skills. However, a gripping aid that also aids fine motor skill development not only assists in the nursing process, but can also stimulate strength, dexterity and independence.

A need therefore existed for an improved nursing bottle with: an open system capable of preventing air from entering the bottle and mixing with liquid during nursing, a hemispherical closed end to ease cleaning, and fine motor dexterity rings to improve the fine motor skills of an infant and to make the bottle easier to grip.

SUMMARY OF THE INVENTION

An object of the present invention is to provide an improved nursing bottle capable of preventing air from entering the bottle and mixing with liquid during nursing.

It is a further object of the present invention to provide a nursing bottle with a hemispherical closed end to ease in the cleaning of the nursing bottle.

It is a still further object of the present invention to provide a nursing bottle with fine motor dexterity rings to improve the fine motor skills and dexterity of an infant and to make the bottle easier to grip.

BRIEF DESCRIPTION OF THE PREFERRED EMBODIMENTS

In accordance with one embodiment of the present invention, an improved nursing bottle assembly is disclosed, comprising, in combination, a bottle having a closed end and an open end, a semi-permeable washer dimensioned to be positioned proximate the open end, and a bottle cap having at least one aperture therethrough, wherein the bottle cap is dimensioned to be removably coupled to the open end of the bottle with the at least one aperture proximate the semi-permeable washer.

In accordance with another embodiment of the present invention, an improved nursing bottle apparatus is disclosed, comprising, in combination, a nursing bottle having a closed end and an open end and an interior surface and an exterior surface, and at least one raised fine motor dexterity ring slidably coupled around the exterior surface of the nursing bottle.

In accordance with still another embodiment of the present invention, an improved nursing bottle is disclosed, comprising a bottle having a closed end and an open end, wherein an exterior portion of the closed end is substantially hemispherical.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
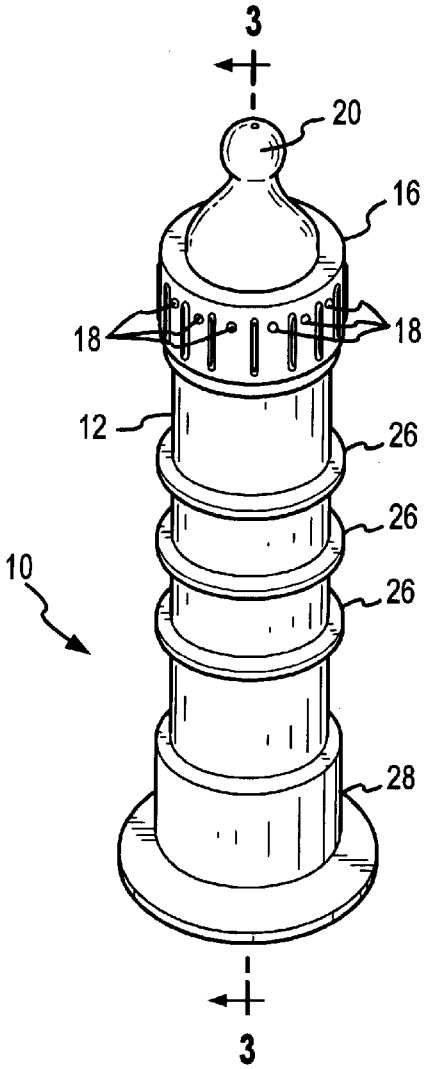
FIG. 1 is a perspective view of the preferred embodiment of the improved nursing bottle of the present invention.

Referring to FIGS. 1, 2, 3, and 4, reference number 10 refers generally to the improved nursing bottle of the present invention. The improved nursing bottle 10 generally comprises a bottle 12 having a closed hemispherical end 30 and an open end 11. A semi-permeable washer 24 is dimensioned to be positioned proximate the open end 11 of the bottle 12.

Still referring to FIGS. 1, 2, 3, and 4, a bottle cap 16, having at least one and preferably a plurality of apertures 18 therethrough, is dimensioned to be removably coupled to the open. end 11 of the bottle 12 with the at least one aperture 18 proximate the semi-permeable washer 24. Preferably, an outer portion 13 of the open end 11 of the bottle 12 is threaded and dimensioned to mate with a corresponding threaded interior portion 17 of the bottle cap 16.

In the preferred embodiment, the bottle 12 further comprises a raised seating ring 15 located below the threaded outer portion 13. The seating ring 15 is positioned on the bottle 12 to prevent the bottle cap 16 from being tightened to a point that would exert so much pressure on the semi-permeable washer 24 as to prevent the effective use of the semi-permeable washer 24.

In the preferred embodiment, each of the at least one aperture 18 has a diameter of approximately 0.0625 inches.

While, in this embodiment, each of the at least one aperture 18 has a diameter of approximately 0.0625 inches, it should be clearly understood that substantial benefit could also be provided from a bottle cap 16 wherein the size of each aperture 18 deviates, even substantially, from the preferred diameter in either direction. Moreover, in the preferred embodiment, the bottle cap 16 has a plurality of apertures 18, it should be clearly understood that substantial benefit could also be provided from a bottle cap 16 having as few as one aperture 18. Although, in the preferred embodiment, the bottle cap 16 has a threaded interior surface 17 for securing the bottle cap 16 to the bottle 12 through a corresponding threaded exterior surface 13 on the open end 11 of the bottle 12, it should be understood that any means of securing the bottle cap 16 to the open end 11 of the bottle 12, such as a snap arrangement, will be within the spirit and scope of this invention. While, in the preferred embodiment, the bottle 12 further comprises a raised seating ring 15, it should be clearly understood that any means for preventing the bottle cap 16 from exerting too much pressure on the semi-permeable washer 24 will be within the spirit and scope of this invention.

Figure 2:
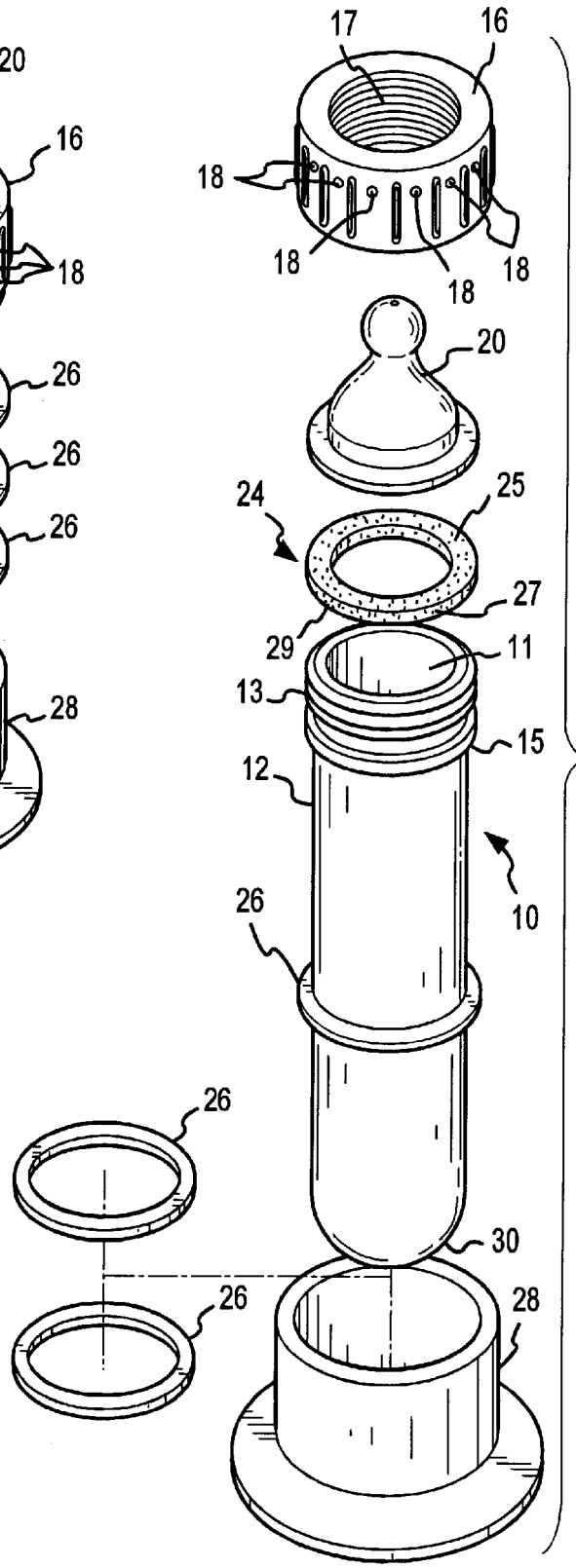
FIG. 2 is an exploded perspective view of the preferred embodiment of the improved nursing bottle of the present invention.
Figure 3:
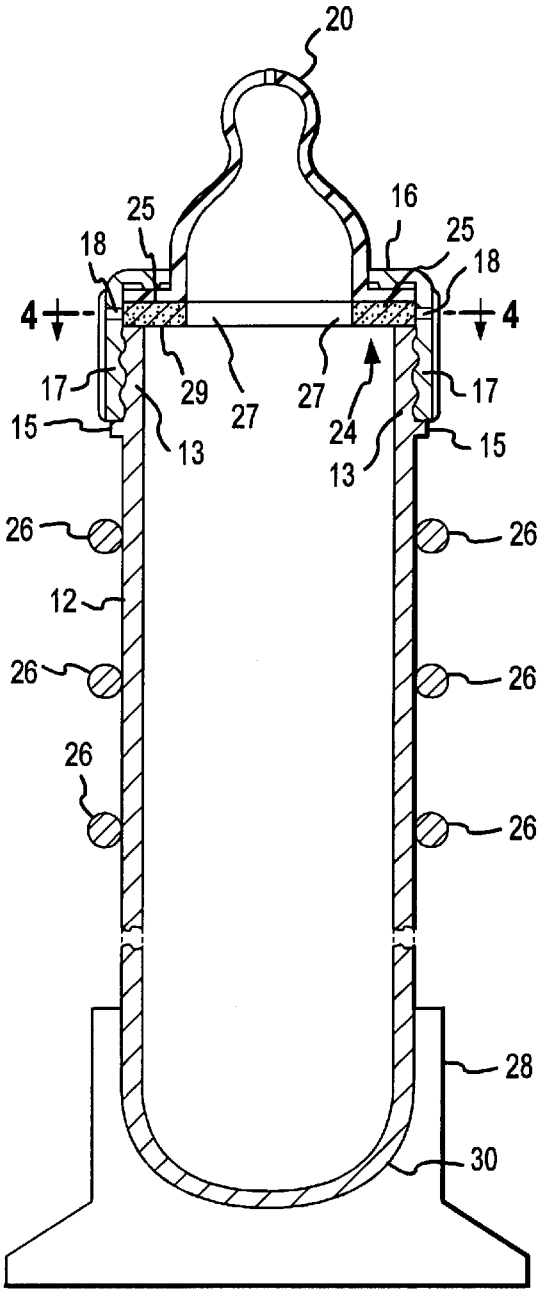
FIG. 3 is a side cross-sectional view of the improved nursing bottle of FIG. 1, taken along line 3—3, showing an alternative embodiment of the bottle holder.
Figure 4:
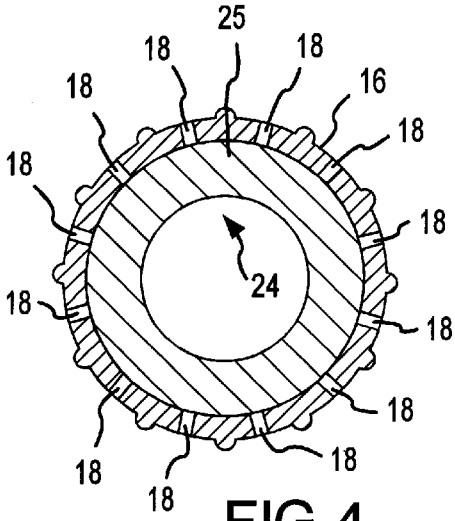
FIG. 4 is a top cross-sectional view of the improved nursing bottle of FIG. 3, taken along line 4—4.

Referring now specifically to FIGS. 2 and 3, the preferred embodiment of the bottle 12 contains a closed hemispherical end 30. The closed hemispherical end 30 eases the cleaning process by allowing a hand-cleaning instrument, such as a brush (not shown), to easily reach the entire interior surface area of the closed hemispherical end 30 of the bottle 12.

Still referring to FIGS. 2 and 3, the semi-permeable washer 24 preferably has: an upper substantially non-permeable surface 25, a lower substantially non-permeable surface 29, and a center semi-permeable area 27 therebetween. The center semi-permeable area 27 is configured to resist the flow of any liquid therethrough having a specific gravity equal to or greater than that of water and to allow air to pass therethrough. In this manner, an open-system nursing bottle 10 is created whereby air is permitted to enter the bottle 12 above the surface of the liquid to prevent a negative pressure build-up from occurring when the infant applies a suction force to the nipple 20. This equilibrium is created when air from outside the bottle 12 passes through the at least one aperture 18 in the bottle cap 16 and the center semi-permeable area 27 of the washer 24 to equalize the pressure exerted by the suction force of the infant. In the preferred embodiment, the semi-permeable washer 24 has an inner diameter of approximately 1 inch, an outer diameter of approximately 1.5 inches, and a thickness of between approximately 0.125 and 0.250 inches—although it should be clearly understood that substantial benefit could also be provided from a washer 24 wherein the inner diameter, outer diameter, and thickness deviate, even substantially, from the preferred diameter and/or thickness in either direction.

Figure 3A:
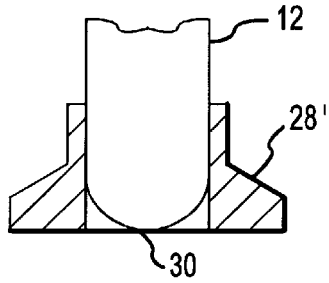
FIG. 3*a* is a side cross-sectional view of the preferred embodiment of the bottle holder of the present invention, taken along line 3—3.

Referring now to FIGS. 1, 2, and 3, reference number 28 refers to the bottle holder used in combination with the nursing bottle 12. In the preferred embodiment, a bottle holder 28' (shown in FIG. 3*a*) is dimensioned to removably receive the closed hemispherical end 30 of the bottle 12, so that the bottle holder 28 supports the bottle 12 in a standing position. Preferably, the bottle holder 28' is open at both ends so that the closed hemispherical end 30 of the bottle 12 can rest on any flat surface. In an alternative embodiment (shown in FIG. 3), the bottle holder 28 has a concave interior surface dimensioned to mate with the closed hemispherical end 30 of the nursing bottle 12, although any configuration allowing the bottle holder 28 to receive the nursing bottle 12 and retain it in a standing position will be sufficient.

Still referring to FIGS. 1, 2, and 3, reference number 26 refers to at least one raised fine motor dexterity ring slidably coupled around an exterior surface of the bottle 12. In the preferred embodiment, the improved nursing bottle 10 includes at least two raised fine motor dexterity rings 26 to improve the fine motor skills and dexterity of an infant (not shown) and to make the bottle 12 easier to grip. Preferably, the raised fine motor dexterity rings 26 can be slidably raised or lowered along the exterior surface of the bottle 12 between the closed hemispherical end 30 and the open end 11. Additionally, it is preferable that the raised fine motor dexterity rings 26 can be removed from the bottle 12 so that both the bottle 12 and the raised fine motor dexterity rings 26 can be cleaned separately. Preferably, each of the at least two raised fine motor dexterity rings 26 is of a different size to stimulate fine motor skill development and dexterity in the infant's hands and fingers. It is also preferable that the raised fine motor dexterity rings 26 comprise different colors, so as to provide visual stimulation for the infant.

While, in the preferred embodiment, the improved nursing bottle 10 includes: (a) a semi-permeable washer 24 together with a bottle cap 16 having at least one aperture 18; (b) at least one raised fine motor dexterity ring 26; and (c) a closed hemispherical end 30 and a mating bottle holder 28—it should be clearly understood that substantial utility could be derived from a bottle 12 having only one, any combination of two, or all three of these features. For example, the improved nursing bottle 10 could comprise only the washer assembly, which consists of the semi-permeable washer 24 and the bottle cap 16 including at least one aperture 18. Additionally, the improved nursing bottle 10 could comprise only a closed hemispherical end 30 with or without the bottle holder 28. Finally, the improved nursing bottle 10 could comprise only a nursing bottle 12 with at least one fine motor dexterity ring 26. While, in the preferred embodiment, the improved nursing bottle 10 includes all three of the aforementioned features, substantial utility could be derived from an improved nursing bottle 10 comprising any two of these features.

While the invention has been particularly shown and described with reference to preferred embodiments thereof, it will be understood by those skilled in the art that the foregoing and other changes in form and details may be made therein without departing from the spirit and scope of the invention.

I claim:

1. An improved nursing bottle assembly comprising in combination:

a bottle having a closed end and an open end;

a semi-permeable washer dimensioned to be positioned proximate said open end; and a bottle cap having at least one aperture therethrough;

wherein said bottle cap is dimensioned to be removably coupled to said open end with said at least one aperture proximate said semi-permeable washer.

2. The assembly of claim 1 wherein an exterior portion of said closed end of said bottle is substantially hemispherical.

3. The assembly of claim 2 further comprising a bottle holder dimensioned to removably receive said closed end of said bottle and to support said nursing bottle assembly in a standing position.

4. The assembly of claim 3 wherein said bottle holder has concave interior surface dimensioned to mate with said hemispherical closed end of said bottle.

5. The assembly of claim 1 wherein said semi-permeable washer comprises:

a washer having an upper substantially non-permeable surface and a lower substantially non-permeable surface and a center semi-permeable area therebetween;

wherein said center semi-permeable area is configured to resist the flow of liquid therethrough and to allow air to pass therethrough.

6. The assembly of claim 1 wherein an outer portion of said open end of said bottle is threaded and dimensioned to mate with a corresponding threaded interior portion of said bottle cap and wherein said bottle further comprises a raised seating ring located below said threaded outer portion.

7. The assembly of claim 1 further comprising at least one raised fine motor dexterity ring slidably coupled around an exterior surface of said bottle.

8. The assembly of claim 7 further comprising at least two raised fine motor dexterity rings.

9. The assembly of claim 8 wherein each of said at least two raised fine motor dexterity rings comprises a different color.

10. The assembly of claim 8 wherein each of said at least two raised fine motor dexterity rings comprises a different thickness.

11. The assembly of claim 1 wherein said semi-permeable washer has an inner diameter of approximately 1 inch.

12. The assembly of claim 1 wherein said semi-permeable washer has an outer diameter of approximately 1.5 inches.

13. The assembly of claim 1 wherein said semi-permeable washer has a thickness of between approximately 0.125 inches and 0.250 inches.

14. The assembly of claim 1 wherein each of said at least one aperture has a diameter of approximately 0.0625 inches.

15. An improved nursing bottle apparatus comprising:

a nursing bottle having a closed end and an open end and an interior surface and an exterior surface; and at least two raised fine motor dexterity rings, said dexterity rings configured such that a child's fingers may be interposed between said dexterity rings said dexterity rings slidably coupled around said exterior surface of said nursing bottle.

16. The apparatus of claim 15 wherein an exterior portion of said closed end of said bottle is substantially hemispherical.

17. The apparatus of claim 15 further comprising a semi-permeable washer comprising:

a washer having an upper substantially non-permeable surface and a lower substantially non-permeable surface and a center semi-permeable area therebetween;

wherein said center semi-permeable area is configured to resist the flow of liquid therethrough and to allow air to pass therethrough.

18. The assembly of claim 17 wherein said semi-permeable washer has an inner diameter of approximately 1 inch.

19. The assembly of claim 17 wherein said semi-permeable washer has an outer diameter of approximately 1.5 inches.

20. The assembly of claim 17 wherein said semi-permeable washer has a thickness of between approximately 0.125 inches and 0.250 inches.

21. The apparatus of claim 17 further comprising:

a bottle cap having at least one aperture therethrough;

wherein said bottle cap is dimensioned to be removably coupled to said open end of said bottle with said at least one aperture proximate said semi-permeable washer.

22. The apparatus of claim 21 wherein an outer portion of said open end of said bottle is threaded and dimensioned to mate with a corresponding threaded interior portion of said bottle cap and wherein said bottle further comprises a raised seating ring located below said threaded outer portion.

23. The apparatus of claim 21 wherein each of said at least one aperture has a diameter of approximately 0.0625 inches.

24. The apparatus of claim 16 further comprising a bottle holder dimensioned to removably receive said closed end of said bottle and to support said nursing bottle assembly in a standing position.

25. The apparatus of claim 24 wherein said bottle holder has a concave interior surface dimensioned to mate with said hemispherical closed end of said bottle.

26. The apparatus of claim 15 wherein each of said at least two raised fine motor dexterity rings comprises a different color.

27. The apparatus of claim 15 wherein each of said at least two raised fine motor dexterity rings comprises a different thickness.

28. A nursing bottle comprising:

a bottle having a closed end and an open end and an open end;

wherein an exterior portion of said closed end is substantially hemispherical; and at least two raised fine motor dexterity rings, said dexterity rings configured such that a child's fingers may be interposed between said dexterity rings around an exterior surface of said nursing bottle.

29. The bottle of claim 28 further comprising a bottle holder dimensioned to removably receive said closed end of said bottle and to support said nursing bottle assembly in a standing position.

30. The bottle of claim 29 wherein said bottle holder has a concave interior surface dimensioned to mate with said hemispherical closed end of said bottle.

31. The bottle of claim 28 further comprising a semi-permeable washer comprising:

a washer having an upper substantially non-permeable surface and a lower substantially non-permeable surface and a center semi-permeable area therebetween;

wherein said center semi-permeable area is configured to resist the flow of liquid therethrough and to allow air to pass therethrough.

32. The assembly of claim 31 wherein said semi-permeable washer has an inner diameter of approximately 1 inch.

33. The assembly of claim 31 wherein said semi-permeable washer has an outer diameter of approximately 1.5 inches.

34. The assembly of claim 31 wherein said semi-permeable washer has a thickness of between approximately 0.125 inches and 0.250 inches.

35. The bottle of claim 31 further comprising:

a bottle cap having at least one aperture therethrough;

wherein said bottle cap is dimensioned to be removably coupled to said open end of said bottle with said at least one aperture proximate said semi-permeable washer.

36. The bottle of claim 35 wherein each of said at least one aperture has a diameter of approximately 0.0625 inches.

37. The bottle of claim 35 wherein an outer portion of said open end of said bottle is threaded and dimensioned to mate with a corresponding threaded interior portion of said bottle cap and wherein said bottle further comprises a raised seating ring located below said threaded outer portion.

* * * * *